US009614302B2

(12) United States Patent
Harwath et al.

(10) Patent No.: US 9,614,302 B2
(45) Date of Patent: Apr. 4, 2017

(54) RIGHT ANGLE COAXIAL CABLE AND CONNECTOR ASSEMBLY

(71) Applicant: CommScope Technologies LLC, Hickory, NC (US)

(72) Inventors: Frank A. Harwath, Naperville, IL (US); Lee F. Allison, Mokena, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 14/996,942

(22) Filed: Jan. 15, 2016

(65) Prior Publication Data

US 2016/0226201 A1 Aug. 4, 2016

Related U.S. Application Data

(60) Provisional application No. 62/111,944, filed on Feb. 4, 2015.

(51) Int. Cl.
*H01R 9/05* (2006.01)
*H01R 4/50* (2006.01)

(52) U.S. Cl.
CPC ..... *H01R 4/5033* (2013.01); *H01R 9/05* (2013.01)

(58) Field of Classification Search
CPC H01R 2103/00; H01R 9/0518; H01R 9/0521; H01R 14/50; H01R 14/40; H01R 13/65807
USPC ..... 439/579, 582, 583, 584
See application file for complete search history.

(56) References Cited

U.S. PATENT DOCUMENTS 4,655,534 A * 4/1987 Stursa ..... H01R 13/646 439/582
4,704,498 A 11/1987 Gregorac
4,881,912 A * 11/1989 Thommen ..... H01R 24/566 439/582
6,287,144 B1 * 9/2001 Baffert ..... H01R 4/28 439/578
6,361,364 B1 * 3/2002 Holland ..... H01R 4/4818 439/578

(Continued)

OTHER PUBLICATIONS

International Search Report and Written Opinion for corresponding PCT Application No. PCT/US2016/016102, date of mailing Jun. 13, 2016.

*Primary Examiner* — Hien Vu
(74) *Attorney, Agent, or Firm* — Myers Bigel, P.A.

(57) ABSTRACT

Coaxial cable-connector assemblies include: a coaxial cable having: an inner conductor having a termination end including a bore; a dielectric layer that overlies the inner conductor; and an outer conductor that overlies the dielectric layer having a termination end; a right angle coaxial connector including: an inner conductor body with a post configured to mate with the inner conductor body of a mating jack, the inner conductor body further including a receptacle that receives the termination end of the inner conductor such that the post is generally perpendicular to the inner conductor; an outer conductor body configured to mate with the outer conductor body of the mating coaxial cable jack and electrically connected with the termination end of the outer conductor; and an expansion member inserted into the bore of the termination end of the inner conductor sized and configured to radially expand the termination end of the inner conductor.

14 Claims, 6 Drawing Sheets

(56) References Cited

U.S. PATENT DOCUMENTS

| | | | | |
|---|---|---|---|---|
| 6,860,761 | B2 * | 3/2005 | Lee | H01R 4/28<br>439/582 |
| 8,628,352 | B2 | 1/2014 | Nugent | |
| 2003/0143893 | A1 | 7/2003 | Hall et al. | |
| 2004/0137790 | A1 | 7/2004 | Lee et al. | |
| 2015/0118898 | A1 | 4/2015 | Paynter et al. | |

* cited by examiner

RIGHT ANGLE COAXIAL CABLE AND CONNECTOR ASSEMBLY

RELATED APPLICATION

The present application claims the benefit of and priority from U.S. Provisional Patent Application No. 62/111,944, filed Feb. 4, 2015, the disclosure of which is hereby incorporated herein by reference in its entirety.

FIELD OF THE INVENTION

The present invention is directed generally to electrical cable connectors, and more particularly to coaxial connectors for electrical cable.

BACKGROUND OF THE INVENTION

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between (a) a cable terminated with a connector bearing the desired connector interface and (b) a corresponding connector with a mating connector interface mounted on an apparatus or on another cable. Typically, one connector will include a structure such as a pin or post connected to an inner conductor and an outer conductor connector body connected to the outer conductor; these are mated with a mating sleeve (for the pin or post of the inner conductor) and another outer conductor connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector.

Passive Intermodulation Distortion (PIM) is a form of electrical interference/signal transmission degradation that may occur with less than symmetrical interconnections and/or as electro-mechanical interconnections shift or degrade over time. Interconnections may shift due to mechanical stress, vibration, thermal cycling, and/or material degradation. PIM can be an important interconnection quality characteristic, as PIM generated by a single low quality interconnection may degrade the electrical performance of an entire RF system. Thus, the reduction of PIM via connector design is typically desirable.

It may be desirable to provide techniques for attaching connectors to cable conductors that exhibit low PIM and relatively low labor manufacturing.

SUMMARY

As a first aspect, embodiments of the invention are directed to a coaxial cable-connector assembly. The assembly comprises a coaxial cable and a right angle coaxial connector. The coaxial cable comprises: an inner conductor having a termination end, the termination end including a bore; a dielectric layer that overlies the inner conductor; and an outer conductor that overlies the dielectric layer having a termination end. The right angle coaxial connector comprises: an inner conductor body comprising a post configured to mate with the inner conductor body of a mating coaxial cable jack, the inner conductor body further including a receptacle that receives the termination end of the inner conductor such that the post is generally perpendicular to the inner conductor; an outer conductor body configured to mate with the outer conductor body of the mating coaxial cable jack, the outer conductor body being electrically connected with the termination end of the outer conductor; and an expansion member inserted into the bore of the termination end of the inner conductor, the expansion member being sized and configured to radially expand the termination end of the inner conductor.

As a second aspect, embodiments of the invention are directed to a right angle coaxial connector assembly, comprising: (a) an inner conductor body configured to mate with the inner conductor body of a mating coaxial cable connector, the inner conductor body including a post that defines a first longitudinal axis and a receptacle configured to receive an inner conductor of a coaxial cable; (b) an outer conductor body configured to mate with the outer conductor body of a mating coaxial cable connector, the outer conductor body comprising: a generally cylindrical cable contact section having a second longitudinal axis that is substantially normal to the first longitudinal axis and configured to be electrically connected with the termination end of the outer conductor; a housing section attached to the cable contact section; and a generally cylindrical connector contact section attached to the housing section having a longitudinal axis that is substantially coincident with the first longitudinal axis, the connector contact section being configured to mate with the outer conductor body of the mating coaxial cable connector; and (c) a dielectric spacer positioned to maintain electrical isolation between the connector contact section of the outer conductor body and the post of the inner conductor body.

As a third aspect, embodiments of the invention are directed to a method of forming a right-angle coaxial cable-connector assembly. The method initially comprises the step of (a) providing a coaxial cable comprising: an inner conductor having a termination end with a bore formed therein; a dielectric layer that overlies the inner conductor; an outer conductor that overlies the dielectric layer having a termination end; and a jacket that overlies the outer conductor. The method also comprises the step of (b) providing a coaxial connector comprising: an inner conductor body configured to mate with the inner conductor body of a mating coaxial cable connector, the inner conductor body including a post that defines a first longitudinal axis and a receptacle configured to receive an inner conductor of a coaxial cable, wherein the receptacle includes a hole; an outer conductor body configured to mate with the outer conductor body of a mating coaxial cable connector, the outer conductor body comprising: a housing section attached to the cable contact section, wherein the housing section includes an access hole aligned on a second longitudinal axis that is substantially normal to the first longitudinal axis; and a dielectric spacer positioned to maintain electrical isolation between the outer conductor body and the post of the inner conductor body. The method further comprises the steps of (c) inserting the coaxial cable through the cable contact section of the outer conductor body, such that the termination end of the inner conductor of the coaxial cable is inserted into the hole in the receptacle of the inner conductor body; and (d) inserting an expansion member through the access hole in the housing section into the bore of the inner conductor, such that the termination end of the inner conductor expands into electrical contact with the receptacle.

As a fourth aspect, embodiments of the invention are directed to an assembly comprising: a first member including a first receptacle; a second member including a second receptacle that receives the receptacle of the first member; and an expansion member inserted into the first receptacle, the expansion member being sized and configured to radially expand the first receptacle into contact with the second receptacle, such contact being sufficient to form a press-fit joint between the first and second receptacles.

DETAILED DESCRIPTION OF EMBODIMENTS OF THE INVENTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
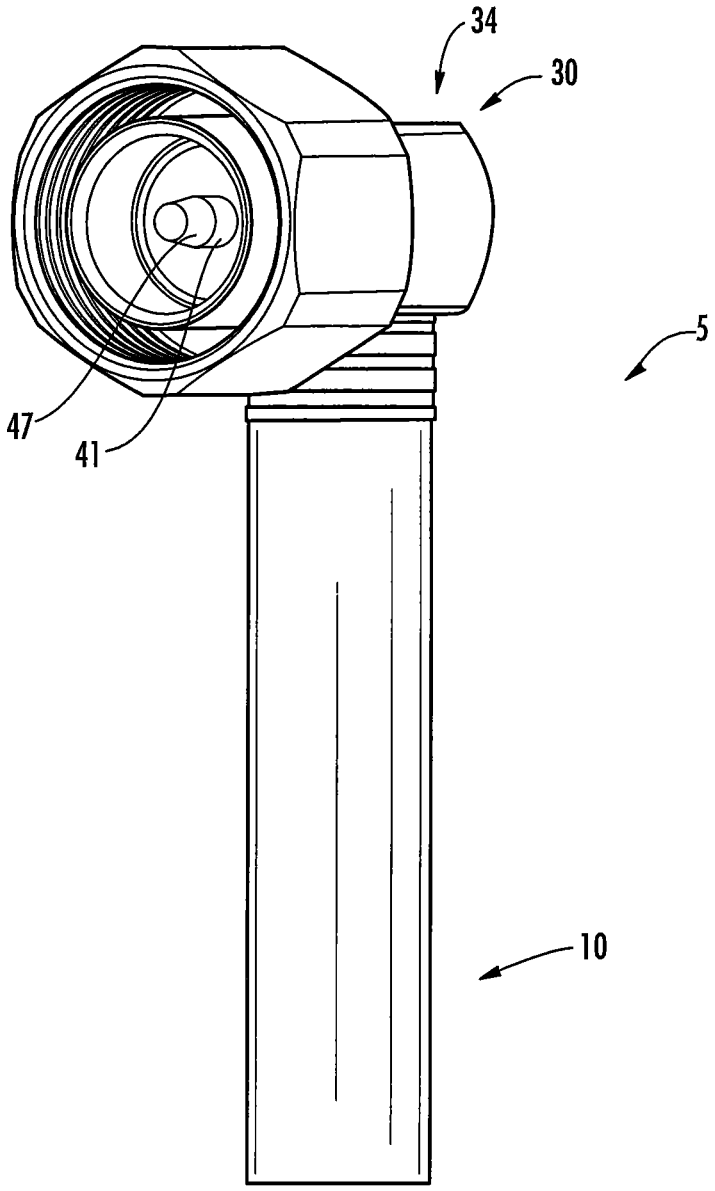
FIG. 1 is a perspective view of a right-angle cable-connector assembly according to embodiments of the present invention.
Figure 2:
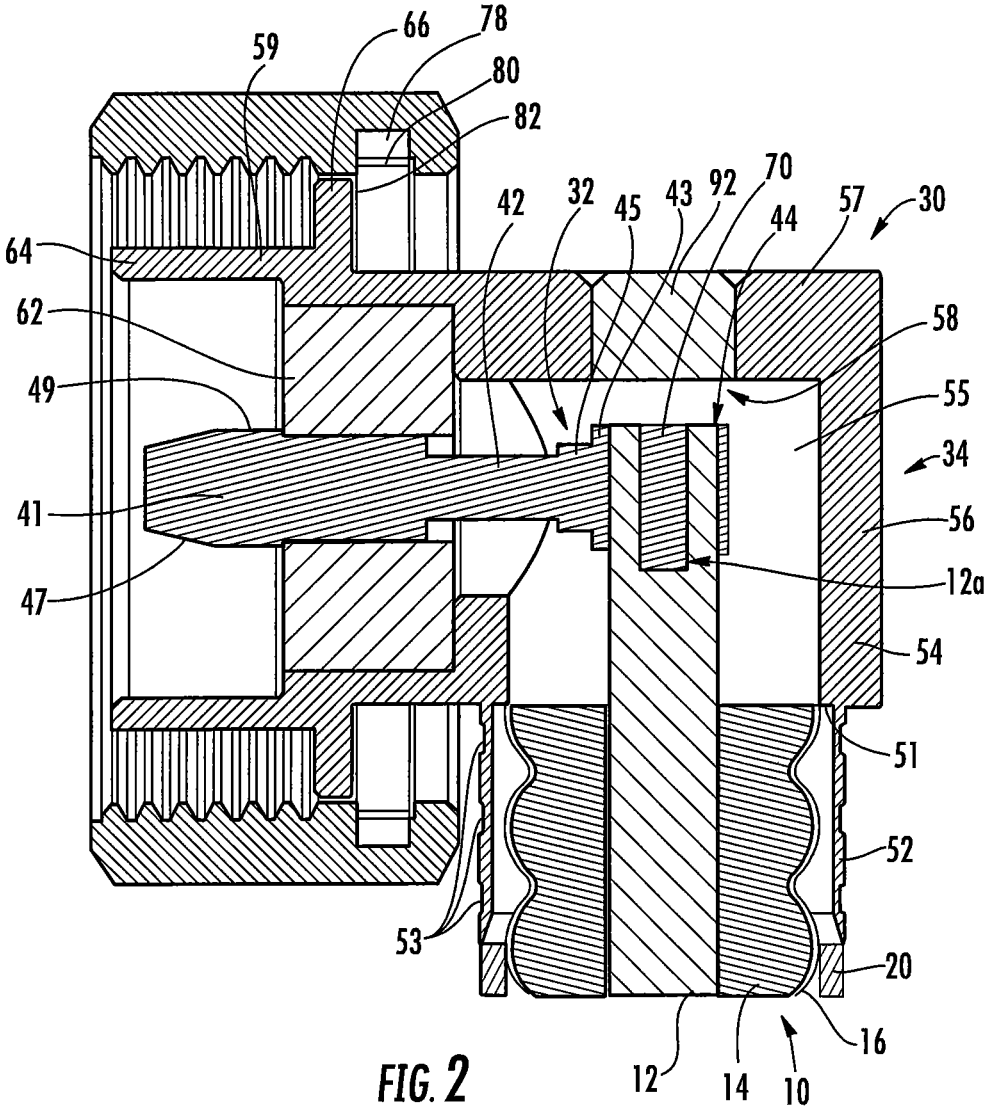
FIG. 2 is a side section view of a portion of the assembly of FIG. 1.
Figure 3:
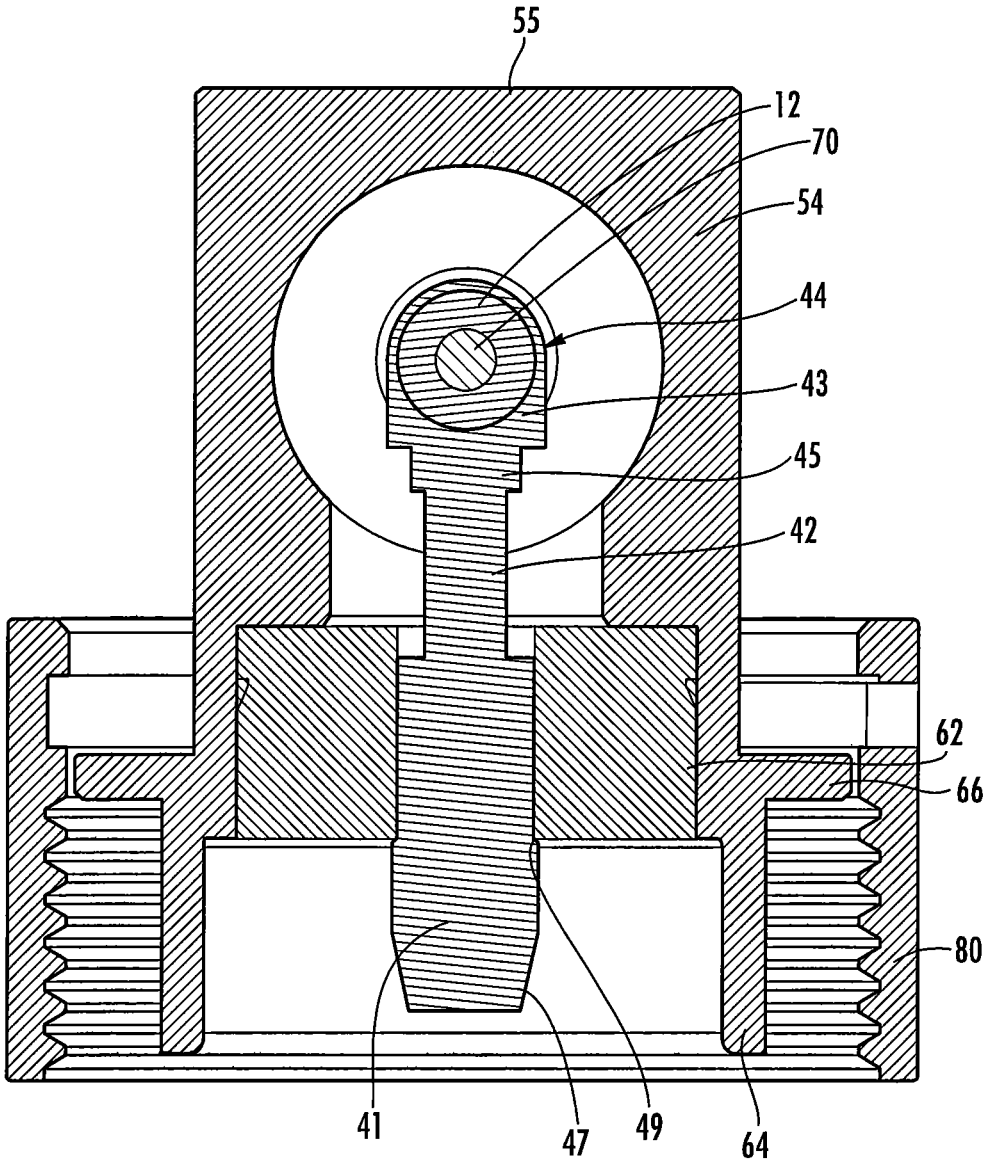
FIG. 3 is a top section of the assembly of FIG. 1.

Referring now to the drawings, a right angle connector-cable assembly, designated broadly at 5, is shown in FIGS. 1-3. The assembly 5 comprises a coaxial cable 10 and a right angle plug 30, each of which is described in detail below.

Figure 5:
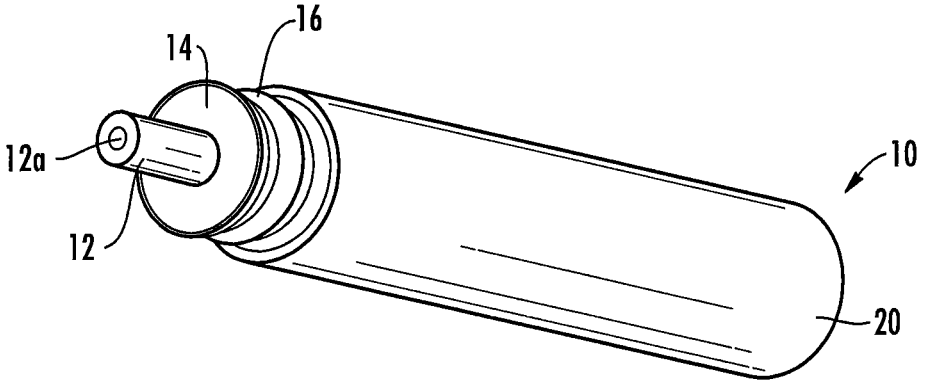
FIG. 5 is a perspective view of the connector end of the inner and outer conductors of the cable of the assembly of FIG. 1.
Figure 6:
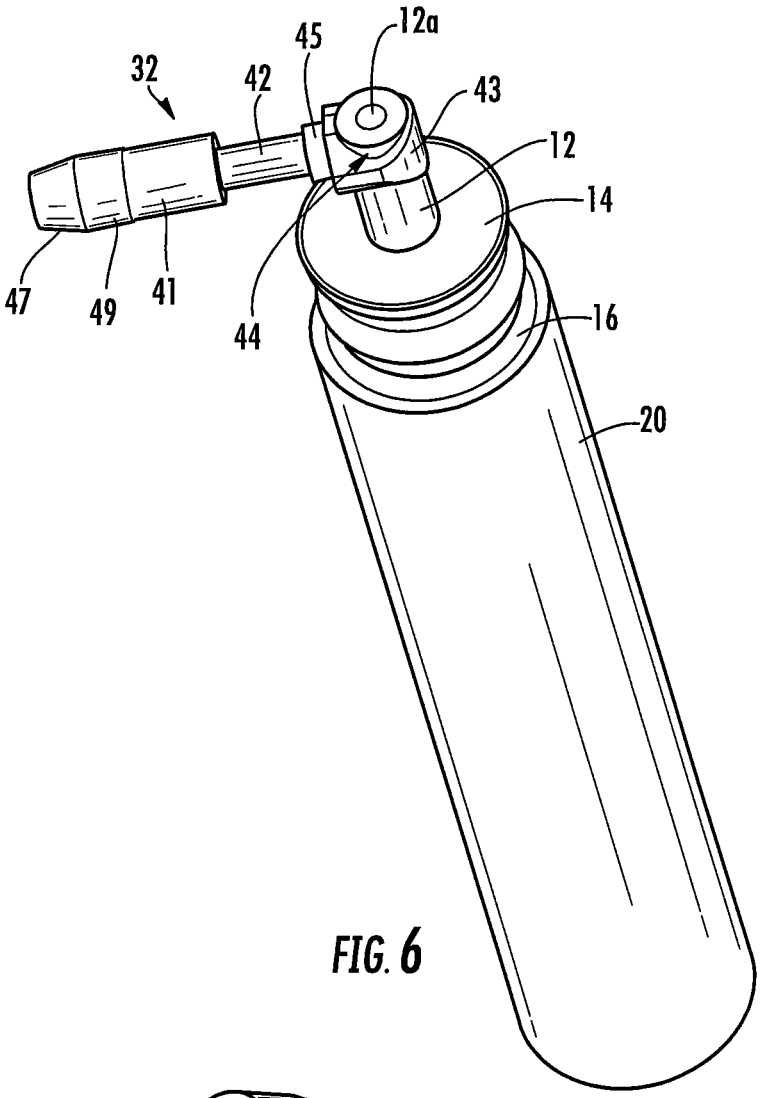
FIG. 6 is a perspective view of the assembly of FIG. 1 prior to the insertion of the dowel in the bore of the inner conductor of the cable, with the outer conductor body and insulator removed for clarity.

Referring to FIGS. 2, 3 and 5, the coaxial cable 10 includes an inner conductor 12, a dielectric layer 14 that circumferentially overlies the central conductor 12, an outer conductor 16 that circumferentially overlies the dielectric layer 14, and a polymeric cable jacket 20 that circumferentially overlies the outer conductor 16. These components will be well-known to those of skill in this art and need not be described in detail herein. Notably, the end of the inner conductor 12 includes a bore 12*a* (best seen in FIG. 5) at its termination end. FIGS. 3 and 5 illustrate that the outer conductor 16 may be of a corrugated profile; alternatively, the outer conductor 16 may have a smooth, braided or foil profile. All of these outer conductor configurations are known to those of skill in this art and need not be described in detail herein.

Figure 4:
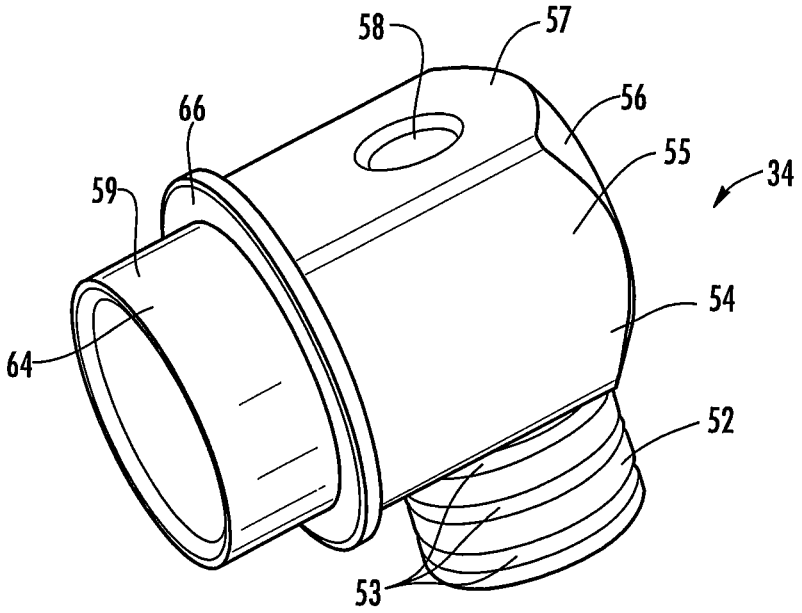
FIG. 4 is a perspective view of the outer conductor body of the assembly of FIG. 1.

Referring to FIGS. 1-4 and 6, the plug 30 includes an inner conductor body 32 and an outer conductor body 34. As can be seen in FIGS. 1, 2 and 4, the inner conductor body 32 is generally cylindrical and comprises a post 41 that is configured to mate with the inner conductor body of a mating jack. A ridge 49 extends radially outwardly from the post 41 near the swaged or chamfered tip 47. A finger 42 with a step 45 extends from one end of the post 41; a contact block 43 or other receptacle with a vertical hole 44 extends from the end of the finger 42.

Referring now to FIGS. 1-4, the outer conductor body 34 includes a cable contact sleeve 52 having three grooves 53. A housing section 54 rests atop the cable contact sleeve 52, forming a shoulder 51. The housing section includes side walls 55, a rear wall 56, and a ceiling 57 with an access hole 58. A connector contact section 59 extends away from the housing section 54 opposite the rear wall 56. A dielectric spacer 62 fills an inner portion of the connector contact section 59 and maintains physical and electrical separation of the inner conductor body 32 and the outer conductor body 34. An annular mating ring 64 extends away from the spacer 62 and is configured to mate with a mating jack. A circular flange 66 extends radially outwardly from the connector contact section 59 and provides a bearing surface 82 for interaction with a coupling nut 80 and/or a retaining clip 78.

Figure 7:
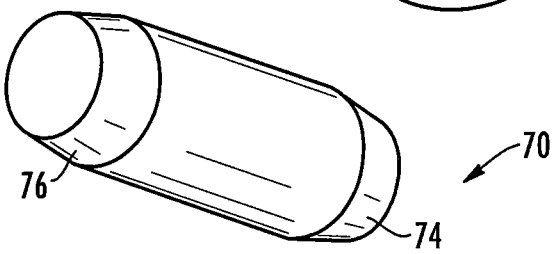
FIG. 7 is a perspective view of the dowel of the assembly of FIG. 1.

Referring now to FIG. 7, a generally cylindrical dowel 70 includes ends 74, 76 that are chamfered. The dowel 70 is sized to be slightly larger than the bore 12*a* of the inner conductor 12 of the cable 10. Also, a plug 92 is sized to fit within and seal the access hole 58 of the ceiling 57 (FIG. 2).

FIGS. 1-3 illustrate the assembled plug 30 and cable 10. The cable contact sleeve 52 of the outer conductor body 34 fits over the outer conductor 16 of the cable 10, with the termination end of the outer conductor 16 abutting the shoulder 51 of the cable contact sleeve 52 to establish an electrical connection. In some embodiments, this joint is completed via soldering. The inner conductor 12 extends into the cavity of the housing section 54. The hole 44 of the contact block 43 of the inner conductor body 32 receives the end of the inner conductor 12, such that the bore 12*a* aligns with the access hole 58. The post 41 of the inner conductor body 32 extends through the dielectric spacer 62 and into the space encircled by the mating ring 64. The right angle nature of the plug 30 is thus established by the perpendicular orientation of the post 41 and the inner conductor 12 and the housing section 54.

The inner conductor body 32 is attached to the inner conductor 12 of the cable 10 via the dowel 70. More specifically, the diameter of the dowel 70 is slightly greater than the diameter of the bore 12*a* of the inner conductor 12. The dowel 70 is passed through the access hole 58 of the ceiling 57 of the housing section 55 (which is substantially collinear with the bore 12*a*), then driven into the bore 12*a* of the inner conductor 12 (typically at high speed and/or under high pressure). Because the dowel 70 is larger than the bore 12*a*, it forces the bore 12*a* radially outwardly to form a high pressure interference fit with the inner surface of the contact block 43 that attaches the inner conductor 12 to the inner conductor body 32 and establishes electrical contact therewith.

Figure 8A:
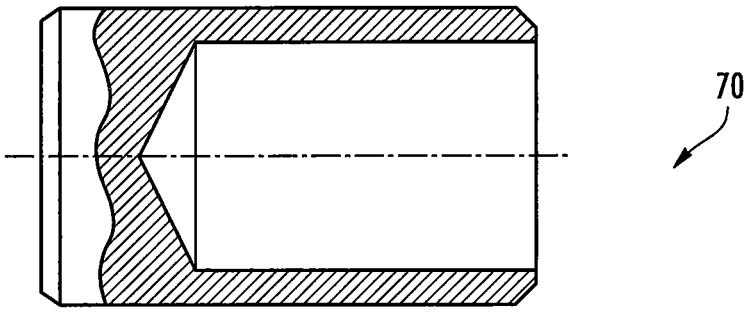
FIGS. 8A-8C are section views of alternative embodiments of dowels suitable for use in the assembly of FIG. 1.
Figure 8B:
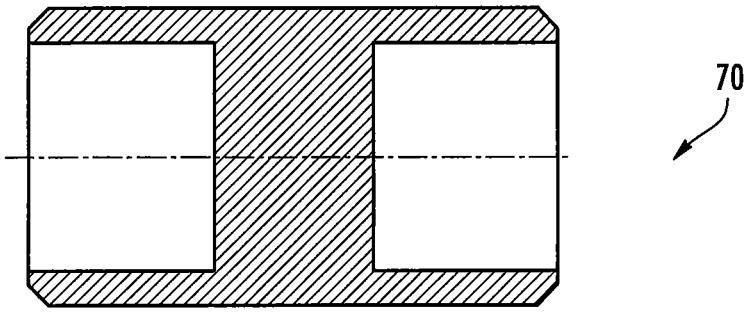
Figure 8C:
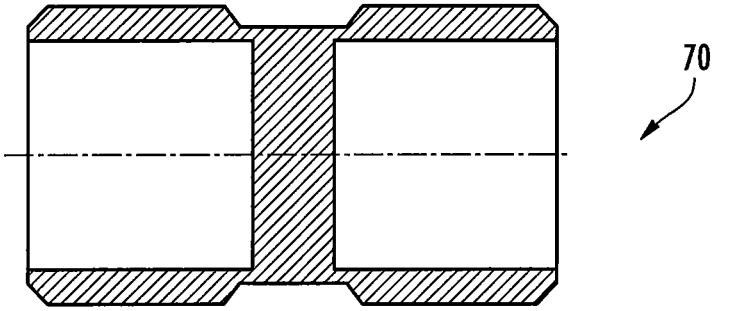

Those skilled in this art will appreciate that the dowel 70 may be replaced with another variety of expansion member that causes the inner conductor 12 to expand radially outwardly sufficiently to form a joint with the contact block 43 of the inner conductor body 32. Also, the dowel or other expansion member may have a smooth surface, or it may have a textured or roughened surface. For example, the dowel's outer surface may be completely or partially knurled (e.g., both ends may be knurled with a smooth central portion, or both ends may be smooth with a knurled central portion, one end may be smooth and the other knurled, etc.). Moreover, the dowel 70 may be partially or completely hollow, which may effectively "soften" the dowel 70, thereby providing a preselected balance of joint strength and stress on the bore 12*a* of the inner conductor 12 of the cable 10, which may be particularly useful in addressing material creep due to stress in the interference fit. For example, the dowel 70 may be hollow at one end (FIG. 8A) or at both ends (FIG. 8B). Alternatively, the dowel 70 may be narrower in a solid section and thicker in a hollow section (FIG. 8C) to maintain contact between the dowel and the contact block 43 along the full length of the dowel 70. Other alternatives may also be suitable.

It should also be noted that, although the hole 44 in the contact block 43 is shown as continuous, it may be discontinuous; for example, the contact block 43 may include one or more slots to encourage radial expansion. Receptacles other than the contact block 43 and or hole 44 may also be suitable for use with the plug 30.

It can thus be seen that connectors according to embodiments of this invention can provide a cable-connector interface where the clamping force is provided by deflection/distortion of one of the members of the mating interface. By using a high pressure interface rather than soldering at this interface, PIM can be reduced significantly.

Those of skill in this art will appreciate that, although the plug 30 is illustrated herein, a jack or other connector may be suitable for use with the concepts discussed above. Also, although a galvanic connection is anticipated between the plug 30 and a mating jack, the concepts may be employed with connectors designed for capacitive coupling (see, e.g., U.S. patent application Ser. No. 14/303,745, filed Jun. 13, 2014, the disclosure of which is hereby incorporated herein in its entirety).

It should also be noted that the arrangement for creating a press-fit joint between the inner conductor 12 and the inner contact 32 with the dowel 70 may be applicable to other components or structures, including other cable-connector assemblies as well as other structural members. An expansion member can be inserted into a first receptacle, wherein such insertion radially expands the first receptacle into contact with a second receptacle in which the first receptacle resides. The radial expansion can create a press-fit joint between the first and second receptacles.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A coaxial cable-connector assembly, comprising:

(a) a coaxial cable comprising:

an inner conductor extending in a first longitudinal axis and having a termination end, the termination end including a bore;

a dielectric layer that overlies the inner conductor; and an outer conductor that overlies the dielectric layer having a termination end; and (b) a right angle coaxial connector comprising:

an inner conductor body comprising a post configured to mate with the inner conductor body of a mating coaxial cable jack, the inner conductor body further including a receptacle at one end that receives the termination end of the inner conductor such that the post is generally perpendicular to the inner conductor;

an outer conductor body configured to mate with the outer conductor body of the mating coaxial cable jack, the outer conductor body being electrically connected with the termination end of the outer conductor; and an expansion member inserted into the bore of the termination end of the inner conductor from a direction opposite with a direction of the first longitudinal axis, the expansion member being sized and configured to radially expand the termination end of the inner conductor to form press fit joint between the inner conductor and the receptacle.

2. The assembly defined in claim 1, wherein the outer conductor body includes an access hole that is substantially collinear with the inner conductor bore.

3. The assembly defined in claim 1, wherein the outer conductor body includes a cable contact section that is in electrical contact with the termination end of the outer conductor.

4. The assembly defined in claim 3, wherein the cable contact section is attached to the termination end of the outer conductor via soldering.

5. The assembly defined in claim 1, wherein the expansion member includes at least one hollow section.

6. A right angle coaxial connector assembly, comprising:

an inner conductor body configured to mate with a second inner conductor body of a mating coaxial cable connector, the inner conductor body including a post that defines a first longitudinal axis and a receptacle configured to receive an inner conductor of a coaxial cable;

an outer conductor body configured to mate with the outer conductor body of a mating coaxial cable connector, the outer conductor body comprising:

a generally cylindrical cable contact section having a second longitudinal axis that is substantially normal to the first longitudinal axis and configured to be electrically connected with the termination end of the outer conductor;

a housing section attached to the cable contact section; and a generally cylindrical connector contact section attached to the housing section having a longitudinal axis that is substantially coincident with the first longitudinal axis, the connector contact section being configured to mate with the outer conductor body of the mating coaxial cable connector; and a dielectric spacer positioned to maintain electrical isolation between the connector contact section of the outer conductor body and the post of the inner conductor body;

wherein a coaxial cable having an inner conductor and an outer conductor, a terminal end of the coaxial cable fits within the hole of the receptacle;

wherein the outer conductor fits within the cable contact section of the outer conductor body; and wherein the inner conductor of the coaxial cable has a bore in the termination end, and further comprising an expansion member inserted into the bore from a direction opposite with a direction of the second longitudinal axis to radially expand the inner conductor into contact with the hole in the receptacle.

7. The connector defined in claim 6, wherein the receptacle of the inner conductor body resides in the housing section.

8. The connector defined in claim 6, wherein the receptacle includes a hole configured to receive a termination end of inner conductor of the coaxial cable.

9. The connector defined in claim 8, wherein the housing section includes an access hole aligned on the second longitudinal axis.

10. The combination defined in claim 6, wherein the cable contact section is soldered onto the outer conductor of the coaxial cable.

11. A method of forming a right-angle coaxial cable-connector assembly, comprising the steps of:

(a) providing a coaxial cable comprising:

an inner conductor having a termination end with a bore formed therein;

a dielectric layer that overlies the inner conductor;

an outer conductor that overlies the dielectric layer having a termination end; and a jacket that overlies the outer conductor;

(b) providing a coaxial connector comprising:

an inner conductor body configured to mate with the inner conductor body of a mating coaxial cable connector, the inner conductor body including a post that defines a first longitudinal axis and a receptacle at one end configured to receive an inner conductor of a coaxial cable, wherein the receptacle includes a hole;

an outer conductor body configured to mate with the outer conductor body of a mating coaxial cable connector, the outer conductor body comprising:

a housing section attached to the cable contact section, wherein the housing section includes an access hole aligned on a second longitudinal axis that is substantially normal to the first longitudinal axis; and a dielectric spacer positioned to maintain electrical isolation between the outer conductor body and the post of the inner conductor body;

(c) inserting the coaxial cable through the cable contact section of the outer conductor body, such that the termination end of the inner conductor of the coaxial cable is inserted into the hole in the receptacle of the inner conductor body; and (d) inserting an expansion member through the access hole in the housing section into the bore of the inner conductor, such that the termination end of the inner conductor expands into electrical contact with the receptacle.

12. The method defined in claim 11, wherein the outer conductor body comprises: a generally cylindrical cable contact section attached to the housing section configured to be electrically connected with the termination end of the outer conductor, the cable contact section having a longitudinal axis that is substantially coincident with the second longitudinal axis; and a generally cylindrical connector contact section attached to the housing section having a longitudinal axis that is substantially coincident with the first longitudinal axis, the connector contact section being configured to mate with the outer conductor body of the mating coaxial cable connector.

13. The method defined in claim 12, further comprising the step of soldering the cable contact section to the termination end of the outer conductor.

14. The method defined in claim 12, wherein the expansion member includes at least one hollow section.

* * * * *